US008562093B2

(12) United States Patent
Xie

(10) Patent No.: US 8,562,093 B2
(45) Date of Patent: Oct. 22, 2013

(54) INKJET PRINTHEAD AND METHOD OF PRINTING WITH MULTIPLE DROP VOLUMES

(71) Applicant: Yonglin Xie, Pittsford, NY (US)

(72) Inventor: Yonglin Xie, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/763,629

(22) Filed: Feb. 9, 2013

(65) Prior Publication Data

US 2013/0201235 A1 Aug. 8, 2013

Related U.S. Application Data

(62) Division of application No. 12/179,788, filed on Jul. 25, 2008, now Pat. No. 8,419,145.

(51) Int. Cl.
*B41J 29/38* (2006.01)
*B41J 2/205* (2006.01)

(52) U.S. Cl.
USPC ..... 347/9; 347/10; 347/11; 347/15

(58) Field of Classification Search
USPC ..... 347/9, 10, 11, 15
See application file for complete search history.

(56) References Cited

U.S. PATENT DOCUMENTS

| | | | | |
|---|---|---|---|---|
| 4,746,935 | A | 5/1988 | Allen | |
| 5,745,131 | A | 4/1998 | Kneezel et al. | |
| 6,161,919 | A | 12/2000 | Klassen | |
| 6,328,399 | B1 | 12/2001 | Wen | |
| 6,629,739 | B2 | 10/2003 | Korol | |
| 2006/0017757 | A1* | 1/2006 | Goto | 347/9 |
| 2007/0126769 | A1 | 6/2007 | Usui | |
| 2008/0062235 | A1 | 3/2008 | Nielsen et al. | |
| 2008/0143786 | A1 | 6/2008 | Oikawa et al. | |
| 2009/0128600 | A1* | 5/2009 | Nagata et al. | 347/40 |

FOREIGN PATENT DOCUMENTS

| | | |
|---|---|---|
| EP | 0 628 415 | 12/1994 |
| EP | 1 157 844 A1 | 11/2001 |

* cited by examiner

*Primary Examiner* — Jannelle M Lebron
(74) *Attorney, Agent, or Firm* — William R. Zimmerli

(57) ABSTRACT

A printhead and a method of ejecting liquid droplets are provided. The method includes providing a printhead operable to eject liquid drops having a plurality of drop volumes $V_i$, for i equal to 1 through n, where n≥2, with $V_j > V_i$ when j>i. One of the plurality of drop volumes is a minimum drop volume $V_{min}$, and a difference in drop volumes between successively larger drops equals $(V_{k+1} - V_k)$ which is less than $V_{min}$, for k equal to 1 through n−1. The method also includes ejecting liquid drops through the printhead.

10 Claims, 2 Drawing Sheets

INKJET PRINTHEAD AND METHOD OF PRINTING WITH MULTIPLE DROP VOLUMES

CROSS-REFERENCE TO RELATED APPLICATIONS

This is a divisional application of U.S. patent application Ser. No. 12/179,788 filed Jul. 25, 2008.

FIELD OF THE INVENTION

The present invention relates to inkjet printing. It finds particular application in conjunction with increasing resolution of inkjet printing and will be described with particular reference thereto. It will be appreciated, however, that the invention is also amenable to other applications.

BACKGROUND OF THE INVENTION

In traditional inkjet technology, image quality is related to the volume of individual ink droplets. With all else being equal, a smaller drop volume results in higher resolution and better image quality. For example, a drop volume for a 600 dpi×600 dpi resolution inkjet printer is about 16.0 pL, while that for a higher quality 1200 dpi×1200 dpi resolution inkjet printer is only about 4 pL. Sub-picoliter drops are required to obtain printed images at greater than 2400 dpi×2400 dpi resolution.

Printheads capable of producing sub-picoliter drops are challenging to manufacture. More specifically, extremely small orifice holes are needed to achieve such sub-picoliter drops. The dimensional accuracy and uniformity of such orifice holes is beyond the capability of existing micro fabrication technologies. Moreover, it is difficult to operate a printhead with small drop volumes due to problems such as jet straightness. In addition, small orifices tend to become clogged more easily by contaminants. Small orifices also have short latency and are difficult to recover after being idle for a period of time.

Due to finite size of spots made by inkjet droplets on the receiving substrate, a halftoning technique is used to produce various levels of gradation for mid-tone shades. Smaller drop volumes achieve higher image quality by producing a finer level of gradation in the mid-tone shades without introducing objectionable graininess or other noises associated with halftoning. Halftoning also reduces the printing speed due to the required processing time for rendering the halftone image.

Another approach for increasing color image quality uses diluted inks. Because less colorant is present in each diluted ink drop, the effect of smaller drops having higher concentration is achieved. However, certain drawbacks to this approach include a higher cost and more complex printing system, issues related to drying, and media cockle due to excess solvents.

The present invention provides a new and improved apparatus and method which addresses the above-referenced problems.

SUMMARY OF THE INVENTION

According to one aspect of the invention, a method of ejecting liquid droplets includes providing a printhead operable to eject liquid drops having a plurality of drop volumes $V_i$, for i equal to 1 through n, where n≥2, with $V_j > V_i$ when j>i. One of the plurality of drop volumes is a minimum drop volume $V_{min}$, and the difference in drop volume between successively larger drops is less than $V_{min}$—i.e., $\delta_{k,\ k+1} = V_{k+1} - V_k < V_{min}$ for k equal to 1 through n−1. The method also includes ejecting liquid drops through the printhead.

According to another aspect of the invention, a method of ejecting ink droplets includes providing a printhead operable to eject liquid drops having a plurality of drop volumes, each of the plurality of drop volumes being ejectable from distinct nozzles, one of the plurality of drop volumes being a minimum drop volume $V_{min}$, another of the plurality of drop volumes being a maximum drop volume $V_{max}$ that is less than two times the minimum drop volume $V_{min}$; and ejecting liquid drops through the printhead.

According to another aspect of the invention, a method of ejecting ink droplets includes providing a printhead operable to eject liquid drops having a plurality of drop volumes, a first of the drop volumes being a minimum drop volume $V_{min}$, respective increments between adjacent drop volumes being $<V_{min}$; and ejecting liquid drops through the printhead.

According to another aspect of the invention, a liquid ejecting apparatus, includes a printhead including a first liquid ejector and a second liquid ejector. The first liquid ejector is operable to eject liquid drops having a first drop volume, which is a minimum drop volume. The second liquid ejector is operable to eject liquid drops having a second drop volume which is greater than the minimum drop volume, an increment between the first and second drop volumes being less than the minimum drop volume.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to exemplify the embodiments of this invention.

DETAILED DESCRIPTION OF THE INVENTION

Figure 1:
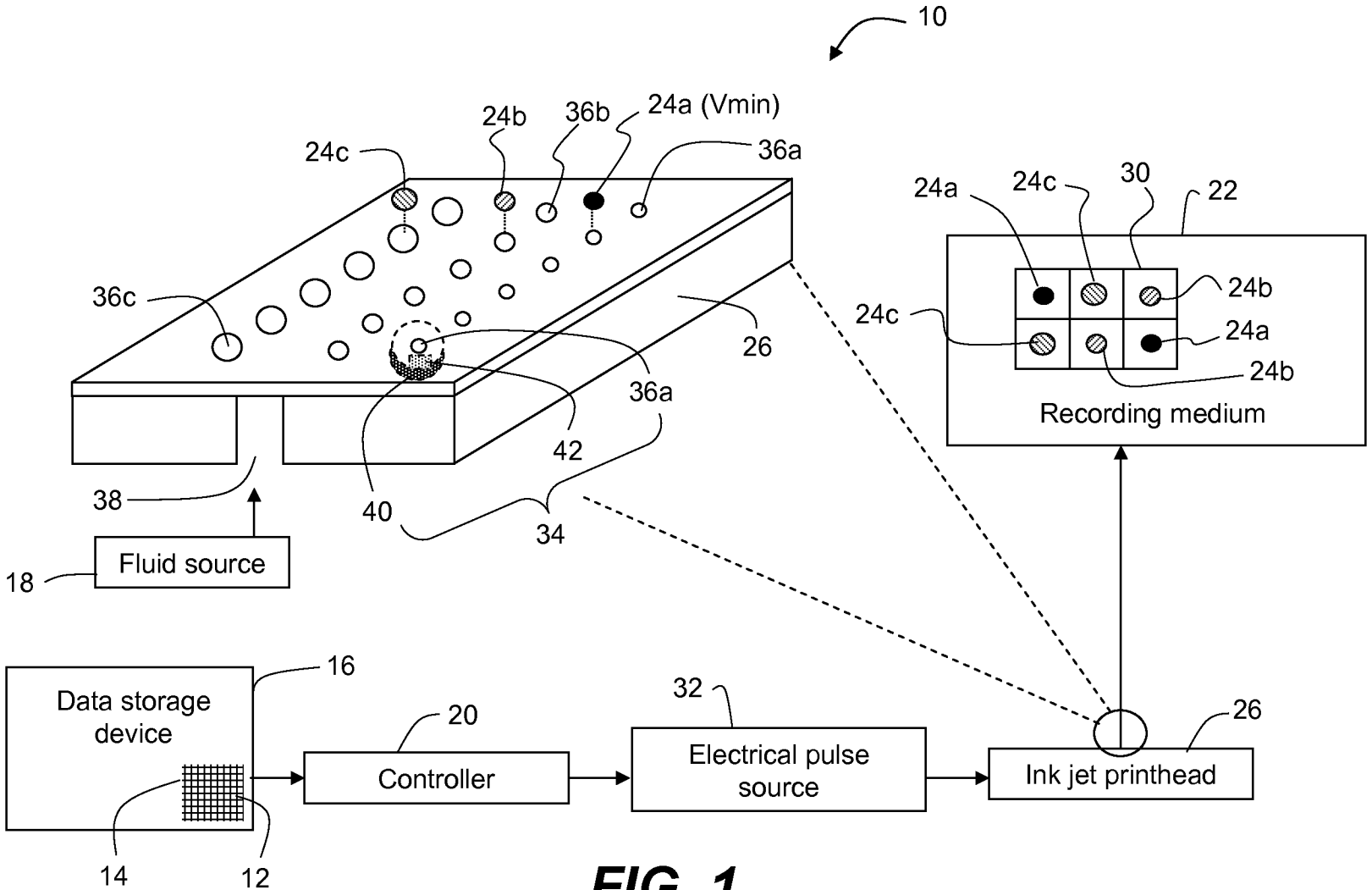
FIG. 1 illustrates a schematic representation of an inkjet printing system in accordance with one embodiment of an apparatus illustrating principles of the present invention.

With reference to FIG. 1, an inkjet printing system 10 is illustrated in accordance with one embodiment of the present invention. Electronic data representing pixels 12 in an image 14 are stored as source data in a storage device 16. A controller 20 reads the electronic source data of the image 14 from the storage device 16. The controller 20 generates electronic signals as a function of the source data. For example, an electronic signal is generated for each pixel 12 in the image 14. The electronic signal represents a color level of the pixel 12. The color level is achieved on a printing medium 22 by ejecting various volumes of ink drops 24*a*, 24*b*, 24*c* from a printhead 26 onto an associated pixel location 30 on the printing medium 22. Although only three (3) different drop volumes are illustrated in FIG. 1, it is to be understood that printheads including any number of different volume ink drops is also contemplated.

The electronic signals are transmitted from the controller 20 to an electrical pulse generator 32. The pulse generator 32 transmits an electronic signal to the ink jet printhead 26 for causing one of the drops 24*a*, 24*b*, 24*c* of a particular volume to be ejected from the printhead 26. Ink is supplied to printhead 26 from fluid source 18 through ink passageway 38. The printhead 26 includes liquid ejectors 34 for ejecting the drops

24*a*, 24*b*, 24*c* of ink. Each of the ejectors 34 includes a nozzle 36, a liquid chamber 40 in fluid communication with ink passageway 38 as well as nozzle 36, and a drop forming mechanism 42 operatively associated with the nozzle 36. The electronic signal from the pulse generator 32 causes the drop forming mechanism 42 to excite ink in the liquid chamber 40 such that the ink is ejected from the printhead through the nozzle 36. A size of the drop 24 ejected from the nozzle 36 is proportional to a desired color level (e.g., grey level) of the color at the particular pixel 12 in the image 14.

In the illustrated embodiment, the printhead 26 includes a plurality of nozzles 36*a*, 36*b*, 36*c* having different nozzle diameters (e.g., three (3) different nozzle diameters). Ink drops ejected from a nozzle with a relatively larger diameter are larger relative to ink drops ejected from a nozzle with a relatively smaller diameter. Although geometrical differences between drop generators (such as nozzle size) is one way to produce different drop volumes, for some types of inkjet printing, the size of the drop forming mechanism or the waveform of the pulse applied to the drop forming mechanism can also provide a range of different drop volumes. The electronic signals from the controller 20, and optionally also logic circuitry (not shown) incorporated in the printhead, determine which of the nozzle(s) 36*a*, 36*b*, 36*c* eject the ink onto the pixel 30 on the received medium 22. More specifically, a first electronic signal is generated if a drop of a first diameter is desired from the nozzle 36*a*; a second electronic signal is generated if a drop of a second diameter is desired from the nozzle 36*b*; and a third electronic signal is generated if a drop of a third diameter is desired from the nozzle 36*c*. The nozzles 36*a*, 36*b*, and 36*c* are all connected to the same fluid source 18 in the example of FIG. 1. Fluid source 18 can be cyan ink for example. For a full color image, additional printheads 26 (not shown), each connected respectively to a fluid source such as magenta ink, yellow ink or black ink would be included in inkjet printing system 10.

In the embodiment illustrated in FIG. 1, the liquid ejectors 34 are arranged in respective arrays according to nozzle diameters.

Traditionally, a drop volume of ≤1 pL is required to produce the smooth gradation of color tones that is characteristic of a 2,400×2,400 dpi quality print.

In one embodiment, it is contemplated that the three (3) drop volumes produced by the respective nozzles 36*a*, 36*b*, 36*c* are 2.0 pL, 2.67 pL, and 3.33 pL. In other words, the minimum drop volume in this example is $V_{min}$=2.0 pl. The difference between the middle drop volume and the minimum drop volume is 0.67 pl, which is less than $V_{min}$. Similarly, the difference between the largest drop volume and the middle drop volume is also 0.67 pl, which is less than $V_{min}$. Using notation $\delta_{k,k+1}$ to denote the difference in drop volume between the $k^{th}$ size drop and the next size larger drop (k+1), $\delta_{1,2}$=2.667−2.0=0.67 pl and $\delta_{2,3}$=3.333−2.667=0.67 pl in this example. If up to two (2) drops of each of the three (3) volumes may be ejected for each pixel in a 600 dpi×600 dpi grid, a total of six (6) drops may be printed in each pixel. Therefore, a total of 16.0 pL may be ejected onto each pixel of the printing medium 22.

TABLE 1

| Level | Combi-nation | Vol 1 (2.000 pL) | Vol 2 (2.667 pL) | Vol 3 (3.333 pL) | Vol/Pxl pL | Delta Vol Δ pL |
|---|---|---|---|---|---|---|
| 1 | 1 | 0 | 0 | 0 | 0.00 | — |
| 2 | 2 | 1 | 0 | 0 | 2.00 | 2.00 |
| 3 | 3 | 0 | 1 | 0 | 2.67 | 0.67 |
| 4 | 4 | 0 | 0 | 1 | 3.33 | 0.66 |
| 5 | 5 | 2 | 0 | 0 | 4.00 | 0.67 |
| 6 | 6 | 1 | 1 | 0 | 4.67 | 0.67 |
| 7 | 7 | 1 | 0 | 1 | 5.33 | 0.66 |
| 7 | 8 | 0 | 2 | 0 | 5.33 | 0.00 |
| 8 | 9 | 0 | 1 | 1 | 6.00 | 0.67 |
| 9 | 10 | 0 | 0 | 2 | 6.66 | 0.66 |
| 9 | 11 | 2 | 1 | 0 | 6.66 | 0.00 |
| 10 | 12 | 2 | 0 | 1 | 7.33 | 0.68 |
| 10 | 13 | 1 | 2 | 0 | 7.33 | 0.00 |
| 11 | 14 | 1 | 1 | 1 | 8.00 | 0.66 |
| 12 | 15 | 1 | 0 | 2 | 8.67 | 0.67 |
| 12 | 16 | 0 | 2 | 1 | 8.67 | 0.00 |
| 12 | 17 | 0 | 1 | 2 | 9.33 | 0.67 |
| 13 | 18 | 2 | 2 | 0 | 9.33 | 0.00 |
| 14 | 19 | 2 | 1 | 1 | 10.00 | 0.66 |
| 15 | 20 | 2 | 0 | 2 | 10.67 | 0.66 |
| 15 | 21 | 1 | 2 | 1 | 10.67 | 0.00 |
| 16 | 22 | 1 | 1 | 2 | 11.33 | 0.67 |
| 17 | 23 | 0 | 2 | 2 | 12.00 | 0.67 |
| 18 | 24 | 2 | 2 | 1 | 12.67 | 0.67 |
| 19 | 25 | 2 | 1 | 2 | 13.33 | 0.66 |
| 20 | 26 | 1 | 2 | 2 | 14.00 | 0.67 |
| 21 | 27 | 2 | 2 | 2 | 16.00 | 2.00 |

Column 1 in Table 1 represents the number of different levels of ink coverage (or gray levels or color levels) achieved by the various combinations of drop volumes identified in Column 2. The numbers in the first row of columns 3-5 (i.e., Vol 1 (V1), Vol 2 (V2), and Vol 3 (V3)) represent the three (3) different respective drop volumes (i.e., 2.000 pL, 2.667 pL, and 3.333 pL). In this embodiment, the incremental volumes between the drops $\delta_{dvol}$ are uniform (i.e., 0.67 pL). The numbers in the body of the table for columns 3-5 represent numbers of drops per pixel for each of the respective drop volumes. Column 6 represents the total volume of ink deposited on a pixel. Column 7 represents the increment Δ of total ink volume per pixel between the current and previous color levels.

The drop volumes are chosen to satisfy the following conditions to provide uniform mid-tone increments:

$$2(V1+V2+V3)=16.0 \text{ pL}$$

$$V1=V_{min}$$

$$V2=V_{min}+\delta_{dvol}$$

$$V3=V_{min}+2\delta_{dvol}$$

$$2V1=V_{min}+3\delta_{dvol}$$

The solution gives $\delta_{dvol}$=0.67 pL and $V_{min}$=2.0 pL. In the illustrated embodiment, $\delta_{dvol}$ is less than $V_{min}$. In addition, V2<2V1 and V3<2V1. Also, V2−V1=V3−V2.

As seen in Table 1, six combinations (i.e., 8, 11, 13, 16, 18, and 21) result in redundant color levels. Such redundant volume levels are beneficial in the sense that if one of the nozzles 36 of the printhead 26 is not usable (e.g., clogged), an alternate combination may be utilized to achieve the desired total volume level.

Because of the redundant color levels, twenty-one (21) different levels may be achieved with a uniform incremental volume per pixel Δ of ~0.67 pL in the mid-tone range (12.5% to 87.5% coverage) (i.e., between levels 2 and 20). In the present example, since the increment Δ of total ink volume per pixel between each of the adjacent levels is uniform (e.g., 0.67 pL) in the mid-tone range, an equivalent resolution of 2,940 dpi×2,940 dpi can be achieved. More specifically, if $\delta_{dvol}$=0.67 pL, then 23.988 (i.e., 16.0 pL/0.667 pL) levels per pixel are possible. Therefore, the resolution of a 600 dpi×600 dpi grid is increased by 4.8987 (i.e., $23.988^{1/2}$) to ~2,940 dpi×2,940 dpi.

Generally, the printhead 26 is operable to eject liquid drops having a plurality of drop volumes $V_i$, for i equal to 1 through n, where n≥2, with $V_j>V_i$ when j>i. One of the plurality of drop volumes is the minimum drop volume $V_1=V_{min}$, and $\delta_{k,\,k+1}=(V_{k+1}-V_k)<V_{min}$, for k equal to 1 through n−1. In the example described above corresponding to Table 1, n=3, but n can be greater than 3 in some embodiments. In addition, in the example described above, $\delta_{1,2}$=0.67 pl=$\delta_{2,3}$, i.e. $\delta_{k,\,k+1}=\delta_{k+1,\,k+2}$ in this example for k equal to 1 through n−2, but in some embodiments the differences in drop volumes between successively larger drops is not always the same.

Fabricating a printhead to produce a minimum drop volume ($V_{min}$) of 2.0 pL (which requires a nozzle of ~9.8 μm) is more feasible than fabricating a printhead to produce a minimum drop volume of 0.67 pL (which requires a nozzle of ~5.7 μm). Thus, the present invention is advantageous for providing an equivalent smoothness of gradation in gray levels, while not requiring such a small nozzle diameter.

With reference to FIG. 1, the controller 20 determines how many drops of the respective volumes are to be ejected onto the various pixel locations 30 as a function of the desired color level at the respective pixel locations 12. For example, if color level 12 is desired at the pixel location 30 on the printing medium 22, the controller 20 determines that two (2) drops of drop volume 2 (2.667 pL) and one drop of drop volume 3 (3.333 pL) are to be ejected to achieve a total volume of 8.67 pL at the pixel location 30.

With reference to Table 2, additional color levels may be achieved if the incremental volumes between the drops $\delta_{dvol}$ is not uniform.

TABLE 2

| Level | Vol 1 (2.0 pL) | Vol 2 (2.8 pL) | Vol 3 (3.2 pL) | Vol/Pxl pL | Delta Vol Δ pL |
|---|---|---|---|---|---|
| 1 | 0 | 0 | 0 | 0.0 | — |
| 2 | 1 | 0 | 0 | 2.0 | 2.0 |
| 3 | 0 | 1 | 0 | 2.8 | 0.8 |
| 4 | 0 | 0 | 1 | 3.2 | 0.4 |
| 5 | 2 | 0 | 0 | 4.0 | 0.8 |
| 6 | 1 | 1 | 0 | 4.8 | 0.8 |
| 7 | 1 | 0 | 1 | 5.2 | 0.4 |
| 8 | 0 | 2 | 0 | 5.6 | 0.4 |
| 9 | 0 | 1 | 1 | 6.0 | 0.4 |
| 10 | 0 | 0 | 2 | 6.4 | 0.4 |
| 11 | 2 | 1 | 0 | 6.8 | 0.4 |
| 12 | 2 | 0 | 1 | 7.2 | 0.4 |
| 13 | 1 | 2 | 0 | 7.6 | 0.4 |
| 14 | 1 | 1 | 1 | 8.0 | 0.4 |
| 15 | 1 | 0 | 2 | 8.4 | 0.4 |
| 16 | 0 | 2 | 1 | 8.8 | 0.4 |
| 17 | 0 | 1 | 2 | 9.2 | 0.4 |
| 18 | 2 | 2 | 0 | 9.6 | 0.4 |
| 19 | 2 | 1 | 1 | 10.0 | 0.4 |
| 20 | 2 | 0 | 2 | 10.4 | 0.4 |
| 21 | 1 | 2 | 1 | 10.8 | 0.4 |
| 22 | 1 | 1 | 2 | 11.2 | 0.4 |
| 23 | 0 | 2 | 2 | 12.0 | 0.8 |
| 24 | 2 | 2 | 1 | 12.8 | 0.8 |
| 25 | 2 | 1 | 2 | 13.2 | 0.4 |
| 26 | 1 | 2 | 2 | 14.0 | 0.8 |
| 27 | 2 | 2 | 2 | 16.0 | 2.0 |

In Table 2, the drop volumes are chosen to satisfy the following conditions:

$$2(V1+V2+V3)=16.0\text{ pL}$$

$$V1=V_{min}$$

$$V2=V_{min}+2\delta_{dvol}$$

$$V3=V_{min}+3\delta_{dvol}$$

$$2V1=V_{min}+5\delta_{dvol}$$

The solution gives $\delta_{dvol}$=0.40 pL and $V_{min}$=2.0 pL. In the illustrated embodiment, $\delta_{dvol}$ is less than $V_{min}$. In addition, V2<2V1 and V3<2V1. In Table 2, (V2−V1)≠(V3−V2), i.e. $\delta_{1,2}\neq\delta_{2,3}$.

As seen in Table 2, twenty-seven (27) different levels may be achieved with a uniform incremental volume per pixel Δ of ~0.4 pL in the mid-tone range (30% to 70% coverage) (i.e., between levels 3 and 25). In the present example, since the increment Δ of total ink volume per pixel between each of the adjacent levels is uniform (e.g., 0.4 pL) in the mid-tone range, an equivalent resolution of 3,795 dpi×3,795 dpi can be achieved. More specifically, if $\delta_{dvol}$=0.40 pL, then 40.0 (i.e., 16.0 pL/0.40 pL) levels per pixel are possible. Therefore, the resolution of a 600 dpi×600 dpi grid is increased by 6.3246 (i.e., $40^{1/2}$) to ~3,795 dpi×3,795 dpi.

Generally, the printhead 26 is operable to eject liquid drops having a plurality of drop volumes $V_i$, for i equal to 1 through n, where n≥2, with $V_j>V_i$ when j>i. (In other words, in this numbering convention for the different drop volumes, the larger the subscript, the larger the drop volume.) One of the plurality of drop volumes is the minimum drop volume $V1=V_{min}$, and $\delta_{k,\,k+1}=(V_{k+1}-V_k)<V_{min}$, for k equal to 1 through n−1. In addition $\delta_{k,\,k+1}\neq\delta_{k+1,\,k+2}$, for some k for examples of the type corresponding to Table 2. Therefore, $V_{k+1}-V_k$, for k equal to 1 through n−1, is not substantially uniform for some value of k.

Figure 2:
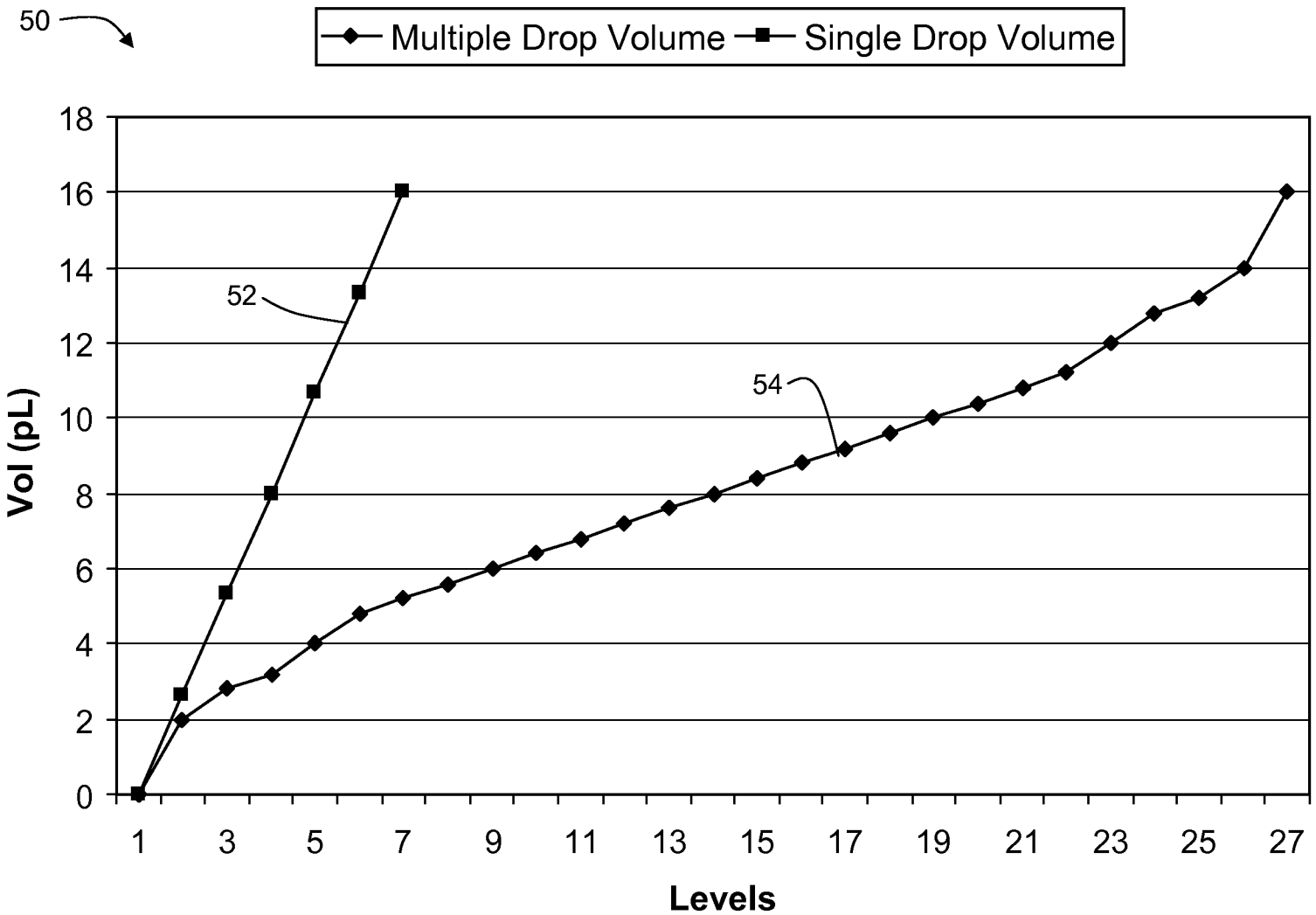
FIG. 2 illustrates a graph of a volume per pixel versus number of color levels.

With reference to FIG. 2, a graph 50 illustrates a volume per pixel versus number of gray levels. A printhead capable of only a single drop volume (e.g., 2.67 pL, which is 16.0 pL/6) can produce seven (7) gray levels when printing six (6) drops per pixel (see line 52). On the other hand, a printhead capable of multiple drop volume printing (as described above in Table 2) can produce twenty-seven (27) gray levels when printing six (6) drops per pixel (see line 54). Comparing the lines 52 and 54 shows the number of gray levels may be increased by almost 4 times when a printhead capable of multiple drop volume printing is used in place of a printhead capable of only single drop volume printing.

Traditionally, a drop volume of ≤0.36 pL is required to produce a 4,000×4,000 dpi quality print.

In another embodiment, a printhead contains nozzles of four (4) different diameter sizes that eject drops of four (4) different volumes (e.g., 1.45 pL, 1.82 pL, 2.18 pL, and 2.55 pL). Up to two (2) drops of each volume (i.e., a total of eight (8) drops) can be printed to obtain 16.0 pL on each of the pixels of a 600 dpi×600 dpi grid.

With reference to Table 3, eight-one (81) different combinations of drop volumes are possible.

TABLE 3

| Level | Combination | Vol 1 (1.450 pL) | Vol 2 (1.815 pL) | Vol 3 (2.180 pL) | Vol 4 (2.545 pL) | Vol/Pxl pL | Delta Vol Δ pL |
|---|---|---|---|---|---|---|---|
| 1 | 1 | 0 | 0 | 0 | 0 | 0.00 | — |
| 2 | 2 | 1 | 0 | 0 | 0 | 1.45 | 1.45 |
| 3 | 3 | 0 | 1 | 0 | 0 | 1.82 | 0.36 |
| 4 | 4 | 0 | 0 | 1 | 0 | 2.18 | 0.36 |

TABLE 3-continued

| Level | Combi-nation | Vol 1 (1.450 pL) | Vol 2 (1.815 pL) | Vol 3 (2.180 pL) | Vol 4 (2.545 pL) | Vol/ Pxl pL | Delta Vol Δ pL |
|---|---|---|---|---|---|---|---|
| 5 | 5 | 0 | 0 | 0 | 1 | 2.55 | 0.36 |
| 6 | 6 | 2 | 0 | 0 | 0 | 2.91 | 0.36 |
| 7 | 7 | 1 | 1 | 0 | 0 | 3.27 | 0.36 |
| 8 | 8 | 0 | 2 | 0 | 0 | 3.64 | 0.36 |
| 8 | 9 | 1 | 0 | 1 | 0 | 3.64 | 0.00 |
| 9 | 10 | 0 | 1 | 1 | 0 | 4.00 | 0.36 |
| 9 | 11 | 1 | 0 | 0 | 1 | 4.00 | 0.00 |
| 10 | 12 | 0 | 0 | 2 | 0 | 4.36 | 0.36 |
| 10 | 13 | 0 | 1 | 0 | 1 | 4.36 | 0.00 |
| 11 | 14 | 2 | 1 | 0 | 0 | 4.73 | 0.36 |
| 11 | 15 | 0 | 0 | 1 | 1 | 4.73 | 0.00 |
| 12 | 16 | 1 | 2 | 0 | 0 | 5.09 | 0.36 |
| 12 | 17 | 2 | 0 | 1 | 0 | 5.09 | 0.00 |
| 12 | 18 | 0 | 0 | 0 | 2 | 5.09 | 0.00 |
| 13 | 19 | 1 | 1 | 1 | 0 | 5.45 | 0.36 |
| 13 | 20 | 2 | 0 | 0 | 1 | 5.45 | 0.00 |
| 14 | 21 | 0 | 2 | 1 | 0 | 5.82 | 0.36 |
| 14 | 22 | 1 | 0 | 2 | 0 | 5.82 | 0.00 |
| 14 | 23 | 1 | 1 | 0 | 1 | 5.82 | 0.00 |
| 15 | 24 | 0 | 1 | 2 | 0 | 6.18 | 0.36 |
| 15 | 25 | 0 | 2 | 0 | 1 | 6.18 | 0.00 |
| 15 | 26 | 1 | 0 | 1 | 1 | 6.18 | 0.00 |
| 16 | 27 | 2 | 2 | 0 | 0 | 6.55 | 0.36 |
| 16 | 28 | 0 | 1 | 1 | 1 | 6.55 | 0.00 |
| 16 | 29 | 1 | 0 | 0 | 2 | 6.55 | 0.00 |
| 17 | 30 | 2 | 1 | 1 | 0 | 6.91 | 0.36 |
| 17 | 31 | 0 | 0 | 2 | 1 | 6.91 | 0.00 |
| 17 | 32 | 0 | 1 | 0 | 2 | 6.91 | 0.00 |
| 18 | 33 | 1 | 2 | 1 | 0 | 7.27 | 0.36 |
| 18 | 34 | 2 | 0 | 2 | 0 | 7.27 | 0.00 |
| 18 | 35 | 2 | 1 | 0 | 1 | 7.27 | 0.00 |
| 18 | 36 | 0 | 0 | 1 | 2 | 7.27 | 0.00 |
| 19 | 37 | 1 | 1 | 2 | 0 | 7.64 | 0.36 |
| 19 | 38 | 1 | 2 | 0 | 1 | 7.64 | 0.00 |
| 19 | 39 | 2 | 0 | 1 | 1 | 7.64 | 0.00 |
| 20 | 40 | 0 | 2 | 2 | 0 | 8.00 | 0.36 |
| 20 | 41 | 1 | 1 | 1 | 1 | 8.00 | 0.00 |
| 20 | 42 | 2 | 0 | 0 | 2 | 8.00 | 0.00 |
| 21 | 43 | 0 | 2 | 1 | 1 | 8.36 | 0.36 |
| 21 | 44 | 1 | 0 | 2 | 1 | 8.36 | 0.00 |
| 21 | 45 | 1 | 1 | 0 | 2 | 8.36 | 0.00 |
| 22 | 46 | 2 | 2 | 1 | 0 | 8.73 | 0.36 |
| 22 | 47 | 0 | 1 | 2 | 1 | 8.73 | 0.00 |
| 22 | 48 | 0 | 2 | 0 | 2 | 8.73 | 0.00 |
| 22 | 49 | 1 | 0 | 1 | 2 | 8.73 | 0.00 |
| 23 | 50 | 2 | 1 | 2 | 0 | 9.09 | 0.36 |
| 23 | 51 | 2 | 2 | 0 | 1 | 9.09 | 0.00 |
| 23 | 52 | 0 | 1 | 1 | 2 | 9.09 | 0.00 |
| 24 | 53 | 1 | 2 | 2 | 0 | 9.46 | 0.36 |
| 24 | 54 | 2 | 1 | 1 | 1 | 9.46 | 0.00 |
| 24 | 55 | 0 | 0 | 2 | 2 | 9.46 | 0.00 |
| 25 | 56 | 1 | 2 | 1 | 1 | 9.82 | 0.36 |
| 25 | 57 | 2 | 0 | 2 | 1 | 9.82 | 0.00 |
| 25 | 58 | 2 | 1 | 0 | 2 | 9.82 | 0.00 |
| 26 | 59 | 1 | 1 | 2 | 1 | 10.18 | 0.36 |
| 26 | 60 | 1 | 2 | 0 | 2 | 10.18 | 0.00 |
| 26 | 61 | 2 | 0 | 1 | 2 | 10.18 | 0.00 |
| 27 | 62 | 0 | 2 | 2 | 1 | 10.55 | 0.36 |
| 27 | 63 | 1 | 1 | 1 | 2 | 10.55 | 0.00 |
| 28 | 64 | 2 | 2 | 2 | 0 | 10.91 | 0.36 |
| 28 | 65 | 0 | 2 | 1 | 2 | 10.91 | 0.00 |
| 28 | 66 | 1 | 0 | 2 | 2 | 10.91 | 0.00 |
| 29 | 67 | 2 | 2 | 1 | 1 | 11.27 | 0.36 |
| 29 | 68 | 0 | 1 | 2 | 2 | 11.27 | 0.00 |
| 30 | 69 | 2 | 1 | 2 | 1 | 11.64 | 0.36 |
| 30 | 70 | 2 | 2 | 0 | 2 | 11.64 | 0.00 |
| 31 | 71 | 1 | 2 | 2 | 1 | 12.00 | 0.36 |
| 31 | 72 | 2 | 1 | 1 | 2 | 12.00 | 0.00 |
| 32 | 73 | 1 | 2 | 1 | 2 | 12.36 | 0.36 |
| 32 | 74 | 2 | 0 | 2 | 2 | 12.36 | 0.00 |
| 33 | 75 | 1 | 1 | 2 | 2 | 12.73 | 0.36 |
| 34 | 76 | 0 | 2 | 2 | 2 | 13.09 | 0.36 |
| 35 | 77 | 2 | 2 | 2 | 1 | 13.46 | 0.36 |
| 36 | 78 | 2 | 2 | 1 | 2 | 13.82 | 0.36 |
| 37 | 79 | 2 | 1 | 2 | 2 | 14.18 | 0.36 |
| 38 | 80 | 0 | 2 | 2 | 2 | 14.55 | 0.36 |
| 39 | 81 | 1 | 2 | 2 | 2 | 16.00 | 1.45 |

Column 1 in Table 3 represents the number of different gray levels (i.e., 39 levels having distinctly different ink volume per pixel) achieved by the various combinations (see column 2) of drop volumes. The numbers in the first row of columns 3-6 (i.e., Vol 1 (V1), Vol 2 (V2), Vol 3 (V3), and Vol 4 (V4)) represent the four (4) different respective drop volumes (i.e., 1.450 pL, 1.815 pL, 2.180 pL and 2.545 pL). In this embodiment, the incremental volumes between the drops $\delta_{dvol}$ are substantially uniform (i.e., ~0.365). The numbers in the body of the table for columns 3-6 represent numbers of drops per pixel for each of the respective drop volumes. Column 7 represents the total volume of ink deposited on a pixel. Column 8 represents the increment Δ of total ink volume per pixel between the current and previous combinations.

It is to be noted in Table 3 that 42 of the combinations result in redundant (not unique) total volume levels (see Vol/Pxl in column 7).

The drop volumes are chosen to satisfy the following conditions to provide uniform mid-tone increments:

$$2(V1+V2+V3+V4)=16.0 \text{ pL}$$

$$V1=V_{min}$$

$$V2=V_{min}+\delta_{dvol}$$

$$V3=V_{min}+2\delta_{dvol}$$

$$V4=V_{min}+3\delta_{dvol}$$

$$2V1=V_{min}+4\delta_{dvol}$$

The solution gives $\delta_{dvol}$=0.365 pL and $V_{min}$=1.45 pL. In the illustrated embodiment, $\delta_{dvol}$ is less than $V_{min}$. In addition, V2<2V1, V3<2V1, and V4<2V1. In Table 3, V4−V3=V3−V2=V2−V1.

As seen in Table 3, the thirty-nine (39) different color levels may be achieved with a uniform incremental volume per pixel Δ of ~0.365 pL in the mid-tone range (9% to 91% coverage) (i.e., between levels 2 and 38). In the present example, since the increment Δ of total ink volume per pixel between each of the adjacent levels is substantially uniform (e.g., ~0.365 pL) in the mid-tone range, an equivalent resolution of 3,973 dpi×3,973 dpi can be achieved. More specifically, if $\delta_{dvol}$=0.365 pL, then 43.8356 (i.e., 16.0 pL/0.365 pL) levels per pixel are possible. Therefore, the resolution of a 600 dpi×600 dpi grid is increased by 6.6208 (i.e., $43.8356^{1/2}$) to ~3,973 dpi×3,973 dpi.

Fabricating a printhead to produce a minimum drop volume ($V_{min}$) of 1.45 pL (which requires a nozzle diameter of ~8.3 μm) is significantly more feasible than fabricating a printhead to produce a minimum drop volume of 0.365 pL (which requires a nozzle diameter of ~4.2 μm).

In another embodiment, a printhead containing nozzles of four (4) different diameters sized to eject drops of four (4) different volumes such that increments between the volumes (e.g., 1.50 pL, 1.75 pL, 2.25 pL, and 2.75 pL) ejected from adjacent nozzles (e.g., 8.5 μm, 9.2 μm, 10.4 μm, and 11.5 μm) are not uniform. Up to two (2) drops of each volume (i.e., a total of eight (8) drops) can be printed to obtain 16.5 pL on each of the pixels of a 600 dpi×600 dpi grid.

With reference to Table 4, at least fifty-three (53) different combinations of drop volumes are possible.

TABLE 4

| Level | Combi-nation | Vol 1 (1.50 pL) | Vol 2 (1.75 pL) | Vol 3 (2.25 pL) | Vol 4 (2.75 pL) | Vol/ Pxl | Delta Vol |
|---|---|---|---|---|---|---|---|
| 1 | 1 | 0 | 0 | 0 | 0 | 0.00 | — |
| 2 | 2 | 1 | 0 | 0 | 0 | 1.50 | 1.50 |
| 3 | 3 | 0 | 1 | 0 | 0 | 1.75 | 0.25 |
| 4 | 4 | 0 | 0 | 1 | 0 | 2.25 | 0.50 |
| 5 | 5 | 0 | 0 | 0 | 1 | 2.75 | 0.50 |
| 6 | 6 | 2 | 0 | 0 | 0 | 3.00 | 0.25 |
| 7 | 7 | 1 | 1 | 0 | 0 | 3.25 | 0.25 |
| 8 | 8 | 0 | 2 | 0 | 0 | 3.50 | 0.25 |
| 9 | 9 | 1 | 0 | 1 | 0 | 3.75 | 0.25 |
| 10 | 10 | 0 | 1 | 1 | 0 | 4.00 | 0.25 |
| 11 | 11 | 1 | 0 | 0 | 1 | 4.25 | 0.25 |
| 12 | 12 | 0 | 1 | 0 | 1 | 4.50 | 0.25 |
| 13 | 13 | 0 | 0 | 2 | 0 | 4.50 | 0.00 |
| 13 | 14 | 2 | 1 | 0 | 0 | 4.75 | 0.25 |
| 14 | 15 | 0 | 0 | 1 | 1 | 5.00 | 0.25 |
| 15 | 16 | 1 | 2 | 0 | 0 | 5.00 | 0.00 |
| 15 | 17 | 2 | 0 | 1 | 0 | 5.25 | 0.25 |
| 16 | 18 | 0 | 0 | 0 | 2 | 5.50 | 0.25 |
| 16 | 19 | 1 | 1 | 1 | 0 | 5.50 | 0.00 |
| 17 | 20 | 2 | 0 | 0 | 1 | 5.75 | 0.25 |
| 17 | 21 | 0 | 2 | 1 | 0 | 5.75 | 0.00 |
| 18 | 22 | 1 | 1 | 0 | 1 | 6.00 | 0.25 |
| 18 | 23 | 1 | 0 | 2 | 0 | 6.00 | 0.00 |
| 19 | 24 | 0 | 2 | 0 | 1 | 6.25 | 0.25 |
| 19 | 25 | 0 | 1 | 2 | 0 | 6.25 | 0.00 |
| 20 | 26 | 1 | 0 | 1 | 1 | 6.50 | 0.25 |
| 20 | 27 | 2 | 2 | 0 | 0 | 6.50 | 0.00 |
| 21 | 28 | 0 | 1 | 1 | 1 | 6.75 | 0.25 |
| 22 | 29 | 1 | 0 | 0 | 2 | 7.00 | 0.25 |
| 22 | 30 | 2 | 1 | 1 | 0 | 7.00 | 0.00 |
| 23 | 31 | 0 | 1 | 0 | 2 | 7.25 | 0.25 |
| 23 | 32 | 0 | 0 | 2 | 1 | 7.25 | 0.00 |
| 23 | 33 | 1 | 2 | 1 | 0 | 7.25 | 0.00 |
| 24 | 34 | 2 | 1 | 0 | 1 | 7.50 | 0.25 |
| 24 | 35 | 2 | 0 | 2 | 0 | 7.50 | 0.00 |
| 25 | 36 | 0 | 0 | 1 | 2 | 7.75 | 0.25 |
| 25 | 37 | 1 | 2 | 0 | 1 | 7.75 | 0.00 |
| 25 | 38 | 1 | 1 | 2 | 0 | 7.75 | 0.00 |
| 26 | 39 | 2 | 0 | 1 | 1 | 8.00 | 0.25 |
| 26 | 40 | 0 | 2 | 2 | 0 | 8.00 | 0.00 |
| 27 | 41 | 1 | 1 | 1 | 1 | 8.25 | 0.25 |
| 28 | 42 | 2 | 0 | 0 | 2 | 8.50 | 0.25 |
| 28 | 43 | 0 | 2 | 1 | 1 | 8.50 | 0.00 |
| 29 | 44 | 1 | 1 | 0 | 2 | 8.75 | 0.25 |
| 29 | 45 | 1 | 0 | 2 | 1 | 8.75 | 0.00 |
| 29 | 46 | 2 | 2 | 1 | 0 | 8.75 | 0.00 |
| 30 | 47 | 0 | 2 | 0 | 2 | 9.00 | 0.25 |
| 30 | 48 | 0 | 1 | 2 | 1 | 9.00 | 0.00 |
| 31 | 49 | 1 | 0 | 1 | 2 | 9.25 | 0.25 |
| 31 | 50 | 2 | 2 | 0 | 1 | 9.25 | 0.00 |
| 31 | 51 | 2 | 1 | 2 | 0 | 9.25 | 0.00 |
| 32 | 52 | 0 | 1 | 1 | 2 | 9.50 | 0.25 |
| 32 | 53 | 1 | 2 | 2 | 0 | 9.50 | 0.00 |
| 33 | 54 | 2 | 1 | 1 | 1 | 9.75 | 0.25 |
| 34 | 55 | 0 | 0 | 2 | 2 | 10.00 | 0.25 |
| 34 | 56 | 1 | 2 | 1 | 1 | 10.00 | 0.00 |
| 35 | 57 | 2 | 1 | 0 | 2 | 10.25 | 0.25 |
| 35 | 58 | 2 | 0 | 2 | 1 | 10.25 | 0.00 |
| 36 | 59 | 1 | 2 | 0 | 2 | 10.50 | 0.25 |
| 36 | 60 | 1 | 1 | 2 | 1 | 10.50 | 0.00 |
| 37 | 61 | 2 | 0 | 1 | 2 | 10.75 | 0.25 |
| 37 | 62 | 0 | 2 | 2 | 1 | 10.75 | 0.00 |
| 38 | 63 | 1 | 1 | 1 | 2 | 11.00 | 0.25 |
| 38 | 64 | 2 | 2 | 2 | 0 | 11.00 | 0.00 |
| 39 | 65 | 0 | 2 | 1 | 2 | 11.25 | 0.25 |
| 40 | 66 | 1 | 0 | 2 | 2 | 11.50 | 0.25 |
| 40 | 67 | 2 | 2 | 1 | 1 | 11.50 | 0.00 |
| 41 | 68 | 0 | 1 | 2 | 2 | 11.75 | 0.25 |
| 42 | 69 | 2 | 2 | 0 | 2 | 12.00 | 0.25 |
| 42 | 70 | 2 | 1 | 2 | 1 | 12.00 | 0.00 |

TABLE 4-continued

| Level | Combi-nation | Vol 1 (1.50 pL) | Vol 2 (1.75 pL) | Vol 3 (2.25 pL) | Vol 4 (2.75 pL) | Vol/ Pxl | Delta Vol |
|---|---|---|---|---|---|---|---|
| 43 | 71 | 1 | 2 | 2 | 1 | 12.25 | 0.25 |
| 44 | 72 | 2 | 1 | 1 | 2 | 12.50 | 0.25 |
| 45 | 73 | 1 | 2 | 1 | 2 | 12.75 | 0.25 |
| 46 | 74 | 2 | 0 | 2 | 2 | 13.00 | 0.25 |
| 47 | 75 | 1 | 1 | 2 | 2 | 13.25 | 0.25 |
| 48 | 76 | 0 | 2 | 2 | 2 | 13.50 | 0.25 |
| 49 | 77 | 2 | 2 | 2 | 1 | 13.75 | 0.25 |
| 50 | 78 | 2 | 2 | 1 | 2 | 14.25 | 0.50 |
| 51 | 79 | 2 | 1 | 2 | 2 | 14.75 | 0.50 |
| 52 | 80 | 1 | 2 | 2 | 2 | 15.00 | 0.25 |
| 53 | 81 | 2 | 2 | 2 | 2 | 16.50 | 1.50 |

Column 1 in Table 4 represents the number of different color levels (i.e., 53 levels) achieved by the various combinations (see column 2) of drop volumes. The numbers in the first row of columns 3-6 (i.e., Vol 1 (V1), Vol 2 (V2), Vol 3 (V3), and Vol 4 (V4)) represent the four (4) different respective drop volumes (i.e., 1.50 pL, 1.75 pL, 2.25 pL and 2.75 pL). In this embodiment, not all of the incremental volumes between the drops $\delta_{dvol}$ are substantially uniform. The numbers in the body of the table for columns 3-6 represent numbers of drops per pixel for each of the respective drop volumes. Column 7 represents the total volume of ink deposited on a pixel. Column 8 represents the increment Δ of total ink volume per pixel between the current and previous combinations.

It is to be noted in Table 4 that 28 of the combinations result in redundant (not unique) total volume levels (see Vol/Pxl in column 7).

The drop volumes are chosen to satisfy the following conditions to provide uniform mid-tone increments:

$$2(V1+V2+V3+V4)=16.5\text{ pL}$$

$$V1=V_{min}$$

$$V2=V_{min}+\delta_{dvol}$$

$$V3=V_{min}+3\delta_{dvol}$$

$$V4=V_{min}+5\delta_{dvol}$$

$$2V1=V_{min}+6\delta_{dvol}$$

The solution gives $\delta_{dvol}$=0.25 pL and $V_{min}$=1.50 pL. In the illustrated embodiment, $\delta_{dvol}$ is less than $V_{min}$. In addition, V2<2V1, V3<2V1, and V4<2V1. In Table 4, V4−V3=V3−V2. However, neither V4−V3 nor V3−V2 equals V2−V1.

As seen in Table 4, the fifty-three (53) different color levels may be achieved with a uniform incremental volume per pixel Δ of ~0.25 pL in the mid-tone range (16.7% to 83.3% coverage) (i.e., between levels 5 and 49). In the present example, since the increment Δ of total ink volume per pixel between each of the adjacent levels is substantially uniform (e.g., ~0.25 pL) in the mid-tone range, an equivalent resolution of 4,874 dpi×4,874 dpi can be achieved. More specifically, if $\delta_{dvol}$=0.25 pL, then 66.0000 (i.e., 16.5 pL/0.25 pL) levels per pixel are possible. Therefore, the resolution of a 600 dpi×600 dpi grid is increased by 8.1240 (i.e., $66.0000^{1/2}$) to ~4,874 dpi×4,874 dpi.

In a color printer capable of printing three (3) colors (e.g., cyan, magenta, yellow (CMY)), a total of 148,877 colors may be achieved at each pixel by combining the fifty-three (53) levels (see Table 4) of each of the three (3) colors. As discussed above, only eight (8) possible colors are achieved from a single drop per pixel binary printing operation and 729 possible colors are achieved from eight (8) drop per pixel printing operation using a single drop size.

It is to be understood that the number of different drop volumes (which are produced by a printhead having nozzles of different diameters), the numbers of drops per pixel for each volume, and the pixel grids described in the various embodiments discussed above are merely examples. Other embodiments having different drop volumes, numbers of drops of pixel for each volume, and pixel grids are also contemplated.

In addition, it is also contemplated that the drops of ink for each drop volume may be printed by the same nozzle or by different nozzles.

In each of the embodiments discussed above, the maximum drop volume $V_{max}$ is less then twice the minimum drop volume $V_{min}$. For example, with reference to Table 1, the minimum drop volume $V_{min}$ is 2.0 pL and the maximum drop volume $V_{max}$ is 3.33 pL. In Table 2, the minimum drop volume $V_{min}$ is 2.0 pL and the maximum drop volume $V_{max}$ is 3.2 pL. In Table 3, the minimum drop volume $V_{min}$ is 1.45 pL and the maximum drop volume $V_{max}$ is 2.55 pL. In Table 4, the minimum drop volume $V_{min}$ is 1.50 pL and the maximum drop volume $V_{max}$ is 2.75 pL. In addition, the increments between the adjacent drop volumes are less than the minimum drop volume $V_{min}$.

With reference to Table 5, a given number of drops per pixel (Drops/Pxl)/total number of possible drop volume combinations (#comb) for a pixel depends on the available number of different drop sizes (#DV) and the number of drops for each drop size ejected onto the pixel (#drops/DV). As seen in Table 5, higher numbers of combinations are achieved with a maximum number of different drop sizes.

TABLE 5

| Drops/Pxl | # DV | # drops/DV | # comb |
|---|---|---|---|
| 4 | 2 | 2 | 9 |
| 4 | 4 | 1 | 16 |
| 6 | 2 | 3 | 16 |
| 6 | 3 | 2 | 27 |
| 6 | 6 | 1 | 64 |
| 8 | 2 | 4 | 25 |
| 8 | 4 | 2 | 81 |
| 8 | 8 | 1 | 256 |

The invention has been described in detail with particular reference to certain preferred embodiments thereof, but it will be understood that variations and modifications can be effected within the scope of the invention.

PARTS LIST

10 Inkjet System
12 Pixel
14 Image
16 Storage Device
18 Fluid Source
20 Controller
22 Printing Medium
24 Ink Drop
26 Printhead
30 Pixel Location on Printing Medium
32 Electrical Pulse Generator
34 Liquid Ejector
36 Nozzle
38 Ink Passageway
40 Liquid Chamber
42 Drop Forming Mechanism
50 Graph
52 Graph Line for Printhead Capable of Single Drop Volume
54 Graph Line for Printhead Capable of Multiple Drop Volumes

The invention claimed is:

1. A method of ejecting ink droplets, comprising:

providing a printhead operable to eject liquid drops having a plurality of drop volumes, the printhead including a plurality of nozzles of different nozzle sizes through which the liquid drops are ejected, the plurality of nozzles including a first nozzle and a second nozzle, the size of the first nozzle being smaller when compared to the size of the second nozzle, the volume of the liquid drop ejected from the first nozzle being a minimum drop volume $V_{min}$, respective increments between adjacent drop volumes being $<V_{min}$, wherein the minimum drop volume is not greater than any other drop volume that can be ejected from the first nozzle and the second nozzle of the printhead; and ejecting liquid drops through the printhead.

2. The method of ejecting ink droplets as set forth in claim 1, wherein a maximum of the drop volumes $V_{max}$ is less than two times the minimum drop volume $V_{min}$.

3. The method of ejecting ink droplets as set forth in claim 1, wherein one of the increments is an integer multiple of the increment between the first drop volume and a second of the drop volumes adjacent to the first drop volume.

4. The method of ejecting ink droplets as set forth in claim 1, wherein providing the printhead operable to eject liquid drops having a plurality of drop volumes includes:

providing a printhead operable to eject liquid drops of different drop volumes from respective nozzles.

5. The method of ejecting ink droplets as set forth in claim 1, wherein each of the increments is substantially uniform.

6. The method of ejecting ink droplets as set forth in claim 5, wherein one of the increments is not substantially uniform with at least one of the other increments.

7. The method of ejecting ink droplets as set forth in claim 1, further including:

providing a recording medium having a pixel location;

determining if at least one of the liquid drops having the first drop volume is to be deposited on the receiving medium at the pixel location; and if it is determined that a liquid drop having the first drop volume is to be deposited on the receiving medium at the pixel location, ejecting the liquid drop of the first drop volume onto the pixel location.

8. The method of ejecting ink droplets as set forth in claim 7, further including:

determining if at least one of the liquid drops having a second drop volume is to be deposited on the receiving medium at the pixel location; and if it is determined that a liquid drop having the second drop volume is to be deposited on the receiving medium at the pixel location, ejecting the liquid drop of the second drop volume onto the pixel location.

9. The method of ejecting ink droplets as set forth in claim 1, further including:

providing a recording medium having a pixel location;

determining a first number of liquid drops having the first drop volume and a second number of liquid drops having a second drop volume to be deposited at the pixel location based on a desired total liquid volume for the pixel location;

selecting a combination of the liquid drops having the first and second drop volumes to be deposited at the pixel location to achieve the desired total liquid volume at the pixel location; and ejecting the combination of liquid drops onto the pixel location.

10. The method of ejecting ink droplets as set forth in claim 9, further including:

selecting the combination from a plurality of combinations that would result in the desired total liquid volume for the pixel location.

* * * * *